US010385414B2

(12) United States Patent
Zou et al.

(10) Patent No.: US 10,385,414 B2
(45) Date of Patent: Aug. 20, 2019

(54) NON-ORIENTED SILICON STEEL AND ITS MANUFACTURING METHOD

(75) Inventors: Liang Zou, Shanghai (CN); Bo Wang, Shanghai (CN); Xiandong Liu, Shanghai (CN); Aihua Ma, Shanghai (CN); Shishu Xie, Shanghai (CN); Hongxu Hei, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 826 days.

(21) Appl. No.: 14/371,013

(22) PCT Filed: Mar. 29, 2012

(86) PCT No.: PCT/CN2012/000400

§ 371 (c)(1),
(2), (4) Date: Jul. 8, 2014

(87) PCT Pub. No.: WO2013/143022

PCT Pub. Date: Oct. 3, 2013

(65) Prior Publication Data

US 2015/0000794 A1 Jan. 1, 2015

(30) Foreign Application Priority Data

Mar. 26, 2012 (CN) ..... 2012 1 0082439

(51) Int. Cl.

| | |
|---|---|
| ***C21D 8/12*** | (2006.01) |
| ***C22C 38/04*** | (2006.01) |
| ***C22C 38/06*** | (2006.01) |
| ***C22C 38/00*** | (2006.01) |
| ***C22C 38/02*** | (2006.01) |
| ***C21C 7/00*** | (2006.01) |
| ***C21C 7/064*** | (2006.01) |
| ***H01F 1/16*** | (2006.01) |
| ***C22C 38/12*** | (2006.01) |
| ***C22C 38/14*** | (2006.01) |
| *H01F 1/147* | (2006.01) |

(52) U.S. Cl.

CPC ..... *C21D 8/1261* (2013.01); *C21C 7/0006* (2013.01); *C21C 7/0645* (2013.01); *C21D 8/12* (2013.01); *C21D 8/1205* (2013.01); *C21D 8/1233* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *H01F 1/16* (2013.01); *C21D 2201/05* (2013.01); *H01F 1/14791* (2013.01)

(58) Field of Classification Search

CPC ..... C21D 8/1261; C21D 8/1233; C22C 38/04
USPC ..... 148/111
See application file for complete search history.

(56) References Cited

FOREIGN PATENT DOCUMENTS

| | | | | |
|---|---|---|---|---|
| CN | 1796015 | A | | 7/2006 |
| CN | 1885712 | A | | 1/2007 |
| CN | 1887512 | | | 1/2007 |
| CN | 1887512 | A | * | 1/2007 |
| CN | 1017A68653 | A | | 7/2010 |
| CN | 101768653 | A | * | 7/2010 |
| CN | 101985719 | A | | 3/2011 |
| CN | 102260822 | A | | 11/2011 |
| CN | 101654757 | A | | 2/2012 |
| CN | 102373366 | A | | 3/2012 |
| CN | 2508629 | A1 | | 10/2012 |
| EP | 2530173 | A1 | | 5/2012 |
| JP | 07-305109 | | | 11/1995 |
| JP | 7305109 | | | 11/1995 |
| JP | 09-228006 | | | 9/1997 |
| JP | 9228006 | A | | 9/1997 |
| WO | 2012024934 | A | | 3/2012 |

OTHER PUBLICATIONS

PCT International Search Report for PCT Application No. PCT/CN2012/000400 dated Jan. 3, 2013 (8 pages).
PCT International Preliminary Report on Patentability and Written Opinion for PCT Application No. PCT/CN2012/000400 dated Oct. 1, 2014 (25 pages).
European Search Report issued in Application No. PCT/CN2012000400 dated Sep. 2, 2015 (6 pages).
Japanese Office Action issued in Application No. JP2015-502031 dated Aug. 25, 2015 (8 pages).
European Office Action issued in Application No. EP12873168.4 dated Jun. 22, 2018 (6 pages).
Mexican Office Action issued in Application No. MX2014/010807 dated Jul. 16, 2018 (12 pages).
Decision of Refusal issued in Application No. JP2015-502031 dated Dec. 18, 2015 (8 pages).

* cited by examiner

*Primary Examiner* — Weiping Zhu
(74) *Attorney, Agent, or Firm* — Eversheds Sutherland (US) LLP

(57) ABSTRACT

An unoriented silicon steel having high magnetic conductivity and low iron loss at a working magnetic density of 1.0-1.5 T and method for manufacturing same. By proper deoxidation control in a RH refining and high-temperature treatment for a short time in a normalizing step, the method can reduce the amount of inclusions in the silicon steel and improve grain shape, so as to improve the magnetic conductivity and iron loss of the unoriented silicon steel at a magnetic density of 1.0-1.5 T.

8 Claims, 2 Drawing Sheets

NON-ORIENTED SILICON STEEL AND ITS MANUFACTURING METHOD

CROSS REFERENCE TO RELATED APPLICATIONS

This application claims the priority benefit of PCT/CN2012/000400 filed on Mar. 29, 2012 and Chinese Application No. 20120082439.4 filed on Mar. 26, 2012. The contents of these applications are hereby incorporated by reference in their entirety.

TECHNICAL FIELD

The present invention relates to a non-oriented silicon steel and its manufacturing method, and specifically a non-oriented silicon steel having a high magnetic permeability and low iron loss at a working magnetic flux density of 1.0~1.5 T and its manufacturing method.

BACKGROUND TECHNOLOGY

As an iron core, a non-oriented silicon steel having high magnetic permeability and low iron loss can be widely used not only in such rotation machines as compressor motors, motors for electric vehicles and small-sized precision motors, but also in such static machines as small-sized power transformers and voltage stabilizer. In recent years, with the increase of people's demands for portability and the decrease of non-renewable energy resources like coal, petroleum, etc., miniaturization and energy saving of electronic devices are required. In view of miniaturization of electronic devices, the non-oriented silicon steel is required to have a high magnetic permeability; and in view of energy saving of electronic devices, the non-oriented silicon steel is required to have a low iron loss. In addition, when used as an iron core in electronic devices such as rotation machines, the non-oriented silicon steel generally has a working magnetic flux density of 1.0~1.5 T. Therefore, in order to realize the miniaturization and energy saving of electronic devices, it is expected to develop a non-oriented silicon steel having high magnetic permeability and low iron loss at a working magnetic flux density of 1.0~1.5 T.

In order to improve the magnetic permeability and the iron loss of non-oriented silicon steel, many studies have been conducted, for example, increasing the purity of ingredients; using Al in combination with minor rare earth elements or Sb to improve a texture of the silicon steel; modifying impurities and oxide inclusions during a steel making; and making an improvement for cold rolling, hot rolling or final annealing process; and the like.

In U.S. Pat. No. 4,204,890, a non-oriented silicon steel having high magnetic permeability and low iron loss under a magnetic induction of 1.5 T is obtained by adding rare earth elements or trace element Sb, using a calcium treatment during steel making process and adopting a low-temperature treatment for long-time in a batch furnace.

In U.S. Pat. No. 4,545,827, a non-oriented silicon steel having excellent peak magnetic permeability and low iron loss is obtained by adjusting carbon content to control carbide precipitation and using temper rolling to obtain favorable ferrite grain size and easily magnetizable texture ingredients.

In U.S. Patent USRE35967, a non-oriented silicon steel having high peak magnetic permeability and low iron loss is obtained by subjecting an austenite zone to high-temperature hot rolling and final rolling at 1,720° and adopting a 0.5% temper rolling under small pressure after final annealing.

Although the above-mentioned prior techniques have made some progress in improving the magnetic permeability and the iron loss of non-oriented silicon steel, there are still some room for non-oriented silicon steel in improving its magnetic permeability and iron loss at a working magnetic flux density of 1.0~1.5 T. It is expected to develop a non-oriented silicon steel having high magnetic permeability and low iron loss at a working magnetic flux density of 1.0~1.5 T, which will meet the miniaturization and energy saving requirements of electronic devices such as rotation machines and static machines.

SUMMARY OF THE INVENTION

The object of the present invention is to provide a non-oriented silicon steel with high magnetic permeability and low iron loss at a working magnetic flux density of 1.0~1.5 T and its manufacturing method. In the present invention, by proper deoxidation control in RH refining and high-temperature treatment for short-time in a normalizing step, the amount of inclusions in the silicon steel is reduced, their morphology is controlled and the morphology of grains is improved , thus a non-oriented silicon steel with high magnetic permeability and low iron loss at a working magnetic flux density of 1.0~1.5 T is obtained. Non-oriented silicon steel according to the present invention can meet the miniaturization and energy conservation requirements of electronic devices such as rotation machines and static machines.

The present invention relates to a method for producing a non-oriented silicon steel, comprising the following steps in sequence: a) steel making, b) hot rolling, c) normalizing, d) cold rolling, and e) annealing, wherein, by the above-mentioned steel making step a), a casting slab containing the following ingredients as calculated by weight percentage is obtained: $C \leq 0.005\%$, $0.1\% \leq Si \leq 2.5\%$, $Al \leq 1.5\%$, $0.10\% \leq Mn \leq 2.0\%$, $P \leq 0.2\%$, $S \leq 0.005\%$, $N \leq 0.005\%$, $Nb+V+Ti \leq 0.006\%$, and the balance being Fe and other inevitable impurities. Said step a) includes RH refining, and a decarbonization and deoxidation treatment is proceed in said RH refining, wherein the input amount of the deoxidizer Y satisfies the following formula: $Y=K \times m \times ([O]-50)$, wherein [O] represents the content of free oxygen in unit of ppm upon the completion of decarbonization; K represents a coefficient indicating deoxidation capacity of the deoxidizer, and is in the range from $0.35 \times 10^{-3}$ to $1.75 \times 10^{-3}$; m represents the weight of molten steel contained in the steel ladle, in the unit of ton; and in said normalizing step c), the hot-rolled steel strip after hot rolling is heated to a temperature of phase transformation point temperature $Ac_1$ or above and 1,100° C. or below and is held for a time period t of 10~90 s.

In the method of the present invention, firstly obtaining a casting slab by steel making, and forming a hot-rolled steel strip by hot rolling the casting slab, then making a normalizing treatment for the hot-rolled steel strip, and forming cold-rolled steel strip by cold rolling the hot-rolled steel strip after normalizing treatment, and finally making a final annealing treatment for the cold-rolled steel strip.

In the method of the present invention, the deoxidizer used in RH refining can be any of those deoxidizers generally used in the silicon steel manufacturing industry, and preferably is aluminum, silicon iron, or calcium, etc. When the deoxidizer is aluminum, K is preferably $0.88 \times 10^{-3}$;

when the deoxidizer is silicon iron, K is preferably $1.23\times10^{-3}$; and when the deoxidizer is calcium, K is preferably $0.70\times10^{-3}$.

In the method of the present invention, proper deoxidation treatment is required in RH refining. In the RH refining of non-oriented silicon steel, deoxidation treatment is a relatively complex process, and has an important function for the quality and production control of silicon steel products. For example, if the content of free oxygen upon completion of decarbonization is high, the amount of oxide inclusions produced in the subsequent alloying process will be extremely high, which will deteriorate the magnetic permeability and iron loss of non-oriented silicon steel and thus affect the quality of silicon steel products; in addition, when the content of free oxygen is high, chemical heating reaction will occur during the alloying process, the temperature of molten steel increases, the overheat degree of casting is too high, the speed of continuous casting production decreases, and thus the productivity of continuous casting is affected. Therefore, in order to obtain a non-oriented silicon steel with high magnetic permeability and low iron loss, it's of vital importance to conduct proper deoxidation treatment in RH refining. Based on a large number of experimental studies by the present inventor on deoxidation in RH refining, the relation curve between the content of free oxygen upon completion of decarbonization and the input amount of deoxidizer capable of realizing deep deoxidation (i.e., the grade of C type inclusions of molten steel is more than grade 1.5) is obtained, and thus the empirical formula between the input amount of deoxidizer Y and the content of free oxygen upon completion of decarbonization [O] is obtained through summarization, i.e., the input amount of deoxidizer Y should satisfy the following formula: $Y=K\times m\times([O]-50)$, wherein [O] represents the content of free oxygen upon completion of decarbonization, in the unit of ppm; K represents the deoxidation capacity coefficient of the deoxidizer, and is preferably $0.35\times10^{-3}\sim1.75\times10^{-3}$; m represents the weight of molten steel in the steel ladle, in the unit of ton. By proper deoxidation control in RH refining, the present invention can reduce the amount of oxide inclusions in the silicon steel, and thus improve the magnetic permeability and the iron loss of non-oriented silicon steel.

Furthermore, in the method of the present invention, in view of the good grain size and low manufacturing cost, the normalizing high-temperature treatment for short-time is required, that's to say, in the normalizing step, it is heated to a temperature of not less than the phase transformation point temperature $Ac_1$ and not more than 1,100° C. and hold for a time t of 10~90 s at the temperature. Pure iron goes through a phase transformation from α to γ at 910° C., and goes through a phase transformation from γ to δ at about 1,400° C.; adding silicon into iron will reduce the γ zone of Fe—C phase diagram. Retaining the single a phase without incurring the above phase transformations when heated under any temperature is very important for the production of non-oriented silicon steel, because no phase transformation under high temperature contributes to orient in easily magnetizable (110) [001] direction by secondary recrystallization, and the growth of non-oriented silicon steel grains and thus significantly increases its magnetic property. In the case that the steel has high purity, the transformation range of α phase zone to γ phase zones is small, and the transformation amount of the two phases is low in the case of short-time normalizing treatment, so phase transformation has little effect on grains. The present invention breaks through the traditional limit that the normalizing temperature is not more than the phase transformation point temperature $Ac_2$, and significantly decreases the normalizing time by increasing the normalizing temperature, and thus the grains are further coarsened (100 μm or more). By the normalizing high-temperature treatment for short-time, the present invention can provide non-oriented silicon steel products which have good (0kl) texture, high magnetic induction, grains easily to grow up and low iron loss upon the final annealing of the cold-rolled sheet.

In the method of the present invention, in view of further reducing the content of N and O in the surface layer of the final silicon steel products and improving the texture of the silicon steel products, the casting slab in said steel making step a) preferably also contains Sn and/or Sb, wherein the amount of Sn is 0.1 wt % or less, and the amount of Sb is 0.1 wt % or less.

In the method of the present invention, in view of the formability of silicon steel, the final rolling temperature in said hot rolling step b) (i.e., temperature upon completion of hot rolling) preferably is 800~900° C.

In the method of the present invention, in said normalizing step c), the steel strip after holding preferably is cooled to 650° C. at a cooling speed of 15° C./s or less and then is naturally cooled. In the normalizing step, a low cooling speed contributes to reduce the effect of α-γ phase transformation on grains and the second-phase precipitate, and thus obtain grains having suitable particle size; in addition, the above control for both cooling temperature and speed in the normalizing step also helps to further promote the aggregation, growth and coarsening of precipitates such as AlN and thus reduce the nitride concentration in the surface layer of non-oriented silicon steel, improve the magnetic permeability and iron loss of non-oriented silicon steel.

In the method of the present invention, in view of obtaining good recrystallized grain structures in the final annealing step, preferably in the aforementioned cold rolling step d), the rolling reduction is 45% or more.

In the method of the present invention, in view of obtaining good grain form, preferably in the aforementioned annealing step e), the cold-rolled steel strip is heated to 700~1,050° C. and hold for 1~120 s (preferably 5~60 s), and then is naturally cooled.

In addition to the production method of non-oriented silicon steel, the present invention also provides a non-oriented silicon steel having high magnetic permeability and low iron loss at a working magnetic density of 1.0~1.5 T, which can be produced from the casting slab containing 0.1~2.5 wt % Si by the production method of the present invention. The magnetic permeability of non-oriented silicon steel satisfies the following formula:

$$\mu_{10}+\mu_{15}\geq8{,}000 \quad (1);$$

$$\mu_{15}\geq865.7+379.4P_{15/50} \quad (2)$$

$$\mu_{10}+\mu_{15}\geq10{,}081-352.1P_{15/50} \quad (3)$$

wherein, $\mu_{10}$ and $\mu_{15}$ respectively represent the magnetic permeability at a magnetic induction of 1.0 T and a magnetic induction of 1.5 T, in the unit of G/Oe; $P_{15/50}$ represents the iron loss in the unit of w/kg under a magnetic induction of 1.5 T at 50 Hz.

The casting slab for producing non-oriented silicon steel in the present invention preferably also contains the following ingredients as calculated by weight percentage: C≤0.005%, Al≤1.5%, 0.10%≤Mn≤2.0%, P≤0.2%, S≤0.005%, N≤0.005%, Nb+V+Ti≤0.006%, Fe and other unavoidable impurities as the remains.

Furthermore, preferably the grain diameter of non-oriented silicon steel in the present invention is 15~300 μm.

Furthermore, preferably the total nitride concentration in the surface layer of 0~20 μm of non-oriented silicon steel in the present invention is 250 ppm or less, and the total nitride concentration is no more than $5.85C_N$, wherein $C_N$ represents the elemental nitrogen concentration, in the unit of ppm.

Furthermore, preferably the S content of non-oriented silicon steel in the present invention is 15 ppm or less.

By proper deoxidation control in RH refining and high-temperature treatment for short-time in the normalizing step, the present invention can reduce the amount of inclusions in the silicon steel, control their shapes and improve grain shapes, thus provide the non-oriented silicon steel with high magnetic permeability and low iron loss at a working magnetic flux density of 1.0~1.5 T. The iron loss $P_{10/50}$ and $P_{15/50}$ of non-oriented silicon steel in the present invention at a thickness of 0.5 mm are respectively 3.0 w/kg or less and 5.5 w/kg or less, and the yield strength $\sigma_s$ of non-oriented silicon steel in the present invention is no less than 220 MPa. The non-oriented silicon steel in the present invention can obtain a motor efficiency of 90% or more when used as iron core in electronic devices such as rotary machines and static machines.

DESCRIPTION OF THE PREFERRED EMBODIMENTS

Figure 1:
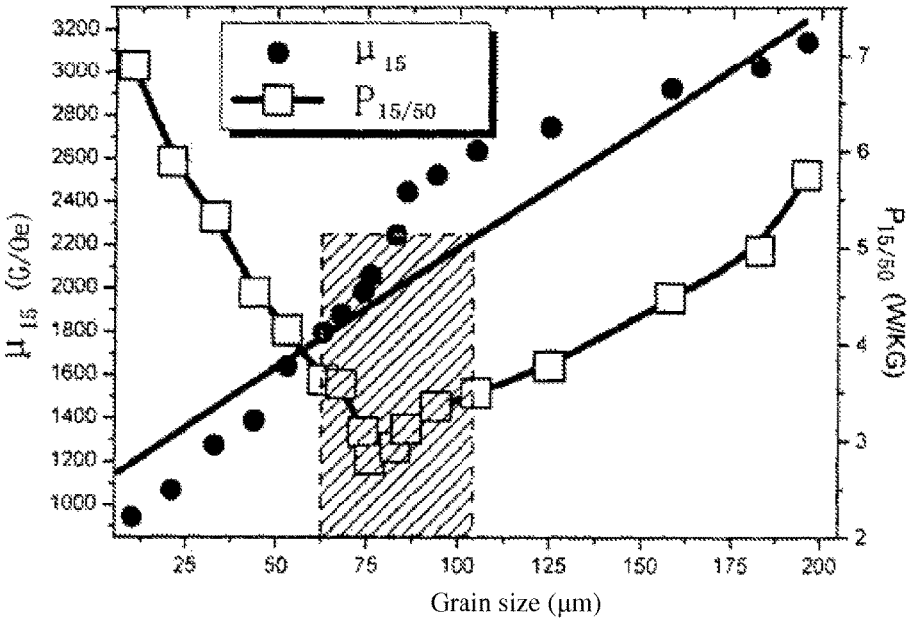
FIG. 1 shows the relation between the grain size of non-oriented silicon steel and its magnetic permeability $\mu_{15}$ and iron loss $P_{15/50}$.

Firstly, the reasons of limiting various ingredients contained in the casting slab for producing non-oriented silicon steel of the present invention are explained below.

Si: being soluble in ferrite to form substitutional solid solution, improving resistivity of the substrate and significantly reducing the iron loss and increasing the yield strength, it is one of the most important alloying elements in non-oriented silicon steel. However, if silicon content is too high, it will deteriorate the magnetic permeability of silicon steel products and the processabilty is difficult. Therefore, in the present invention, Si content is limited to 0.1-2.5 wt %.

Al: being soluble in ferrite to improve resistivity of the substrate, coarsing grains and reducing eddy current loss, and hardly deteriorating the magnetic permeability of silicon steel products. In addition, Al also has the effect of deoxidation and nitrogen fixation. However, if Al content is too high, smelting and casting will be difficult, and thus subsequent processability is difficulty. In the present invention, Al content is limited to 1.5 wt % or less.

Mn: being similar to Si and Al, it also can improve resistivity of steel and reduce iron loss; in addition, Mn can enlarge γ phase zone, slow down the phase transformation speed from γ to α, and thus effectively improve hot rolling plasticity and hot-rolled sheet structure. Meanwhile, Mn can bond with the impurity element S to form stable MnS and eliminate the harm of S for magnetic property. If Mn content is too low, the above beneficial effects are not obvious; if Mn content is too high, it will deteriorate the beneficial texture. In the present invention, Mn content is limited to 0.1-2.0 wt %.

P: adding a certain amount of phosphorus into steel can improve the processability of steel strip, however, if P content is too high, it will deteriorate the cold rolling processability of steel strip. In the present invention, P content is limited to 0.2% or less.

C: being harmful for magnetic property, it is an element which intensively hinders the growth of grains while expanding the γ phase zone; an excessive amount of C will increase the transformation amounts of both phase zones α and γ in normalizing treatment, significantly reduce the phase transformation point temperature $Ac_1$, cause the abnormal refinement of crystal structure and thus increase iron loss. In addition, if the content of C as an interstitial element is too high, it will be disadvantage for the improvement of the fatigue property of silicon steel. In the present invention, C content is limited to 0.005 wt % or less.

S: being harmful for both processability and magnetic property, it is easy to form fine MnS particles together with Mn, hinder the growth of annealed grains of the finished products and severely deteriorate magnetic property. In addition, it is easy for S to form low-melting-point FeS and $FeS_2$ or eutectic together with Fe and cause the problem of hot processing brittleness. In the present invention, S content is limited to 0.005 wt % or less.

N: it is easy for N as an interstitial element to form fine dispersed nitrides with Ti, Al, Nb or V, and it also intensively hinders the growth of grains and deteriorates iron loss. If N content is too high, the amount of nitride precipitates increases, which intensively hinders the growth of grains and deteriorates iron loss. In the present invention, N content is limited to 0.005 wt % or less.

Nb, V, Ti: all of they are elements unfavorable for magnetic property. In the present invention, the total content of Nb, V and Ti is limited to 0.006 wt % or less.

Sn, Sb: as segregation elements, they have the effect of surface oxidation resistance and surface nitridation resistance. Adding an appropriate amount of Sn and/or Sb contributes to increase aluminum content in silicon steel and prevent the formation of a nitride layer in the surface layer of silicon steel. In the present invention, Sn content is set to 0.1 wt % or less, and Sb content is set to 0.1 wt % or less.

Next, the present inventor investigates the effect of the grain size of non-oriented silicon steel (silicon content: 0.85~2.5 wt %; thickness of silicon steel: 0.5 mm) on the magnetic permeability $\mu_{15}$, iron loss $P_{15/50}$ and yield strength $\sigma_s$. The results are shown in FIG. 1 and FIG. 2.

FIG. 1 shows the relation between the grain size of non-oriented silicon steel and its magnetic permeability $\mu_{15}$ and iron loss $P_{15/50}$. It can be seen from FIG. 1 that, when the grain size of non-oriented silicon steel is between 60 μm and 105 μm, non-oriented silicon steel with both high magnetic permeability and low iron loss can be obtained.

Figure 2:
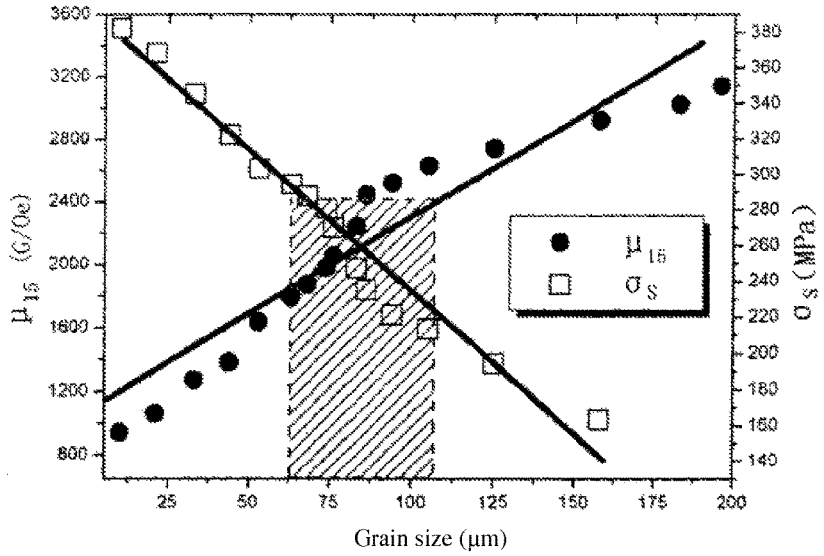
FIG. 2 shows the relation between the grain size of non-oriented silicon steel and its magnetic permeability $\mu_{15}$ and yield strength.

FIG. 2 shows the relation between the grain size of non-oriented silicon steel and its magnetic permeability $\mu_{15}$ and yield strength $\sigma_s$. It can be seen from FIG. 2 that, when the grain size of non-oriented silicon steel is between 60 μm and 105 μm, non-oriented silicon steel with both high magnetic permeability and yield strength can be obtained.

Figure 3:
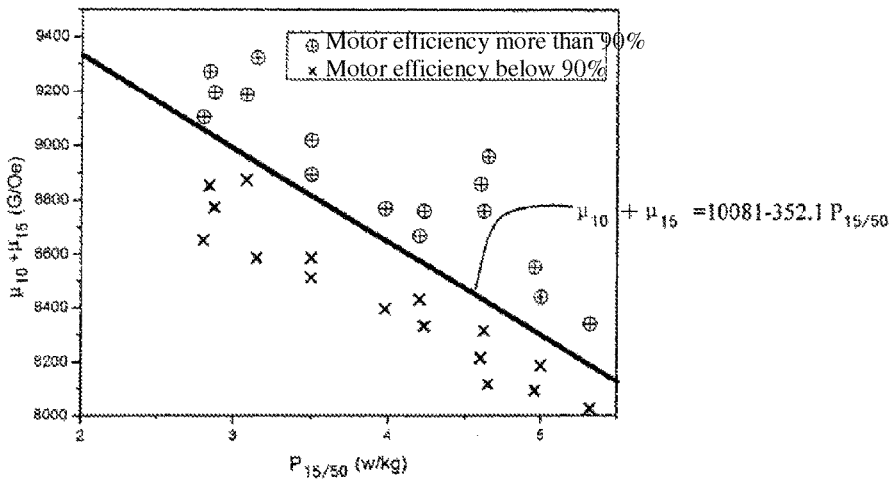
FIG. 3 shows the relation between the magnetic permeability ($\mu_{10}+\mu_{15}$) and iron loss $P_{15/50}$ of non-oriented silicon steel and its motor efficiency.

Furthermore, the present inventor investigates the effect of the magnetic permeability ($\mu_{10}+\mu_{15}$) and iron loss $P_{15/50}$ of non-oriented silicon steel (0.5 mm thickness) on its motor efficiency. FIG. 3 shows the relation between the magnetic permeability ($\mu_{10}+\mu_{15}$) and iron loss $P_{15/50}$ of non-oriented silicon steel and its motor efficiency, and the motor used is a 11 kw~6 grade motor. The inventor finds from FIG. 3 that, when the magnetic permeability ($\mu_{10}+\mu_{15}$) and iron loss $P_{15/50}$ of non-oriented silicon steel satisfy the following formula, a high motor efficiency can be obtained.

$$\mu_{10}+\mu_{15}\geq 8{,}000 \quad (1);$$

$$\mu_{15}\geq 865.7+379.4P_{15/50} \quad (2)$$

$$\mu_{10}+\mu_{15}\geq 10{,}081-352.1P_{15/50} \quad (3)$$

Next, the present invention will be further described in conjunction with examples, but the protection scope of the present invention is not limited to these examples.

EXAMPLE 1

Firstly, a casting slab containing the following ingredients as calculated by weight percentage is obtained by steel making: C 0.0035%, Si 0.85%, Al 0.34%, Mn 0.31%, P 0.023%, S 0.0027% and N 0.0025%, Fe and other unavoidable impurities as the remains; RH refining is used in the steel making, wherein Al as the deoxidizer is used for deoxidation treatment in RH refining. In Example 1, the weight of molten steel in the steel ladle is 285 ton, the content of free oxygen upon completion of decarbonization is 550 ppm, and the input amount of Al is 125 kg.

Next, the casting slab is subject to hot roll to form hot-rolled steel strip, wherein the final rolling temperature is 800° C. or more, and the thickness of hot-rolled steel strip after hot rolling is 2.6 mm.

Then, the hot-rolled steel strip is subject to the normalizing high-temperature treatment for short-time, i.e., the hot-rolled steel strip is heated to 980° C. and hold for 20 s, and then is cooled to 650° C. at a cooling speed of about 15° C./s, and is naturally cooled.

Next, the hot-rolled steel strip after normalizing treatment is subject to cold roll to form the cold-rolled steel strip, which has a thickness of 0.5 mm after cold rolling.

Finally, at an atmosphere of nitrogen and hydrogen, it is subject to anneal at 800° C. for 18 s, and thus non-oriented silicon steel in Example 1 is obtained.

EXAMPLE 2

Non-oriented silicon steel in Example 2 is produced in the same method as that used in Example 1, except the content of free oxygen upon completion of decarbonization and the input amount of Al are respectively changed to 400 ppm and 87.5 kg.

EXAMPLE 3

Non-oriented silicon steel in example 3 is produced in the same method as that used in Example 1, except the content of free oxygen upon completion of decarbonization and the input amount of Al are respectively changed to 300 ppm and 62.5 kg.

EXAMPLE 4

Non-oriented silicon steel in Example 3 is produced in the same method as that used in Example 1, except the content of free oxygen upon completion of decarbonization and the input amount of Al are respectively changed to 280 ppm and 57.5 kg.

COMPARATIVE EXAMPLE 1

Non-oriented silicon steel is produced in the same method as that used in Example 1 except the input amount of Al is changed to 115 kg.

COMPARATIVE EXAMPLE 2

Non-oriented silicon steel is produced in the same method as that used in Example 1 except the input amount of Al is changed to 135 kg.

COMPARATIVE EXAMPLE 3

Non-oriented silicon steel is produced in the same method as that used in Example 1, except there is no deoxidation treatment in RH refining.

The inclusions of non-oriented silicon steel (0.5 mm thickness) in the above examples and comparative examples are evaluate in grade by GB10561-2005 method, and their magnetic permeability ($\mu_{10}+\mu_{15}$), iron loss $P_{10/50}$ and $P_{15/50}$ and motor efficiency (11 kw~6 grade motor) are measured. The results are shown in Table 1.

TABLE 1

| | Deoxidation in RH refining | | | | | Magnetic property | | | |
|---|---|---|---|---|---|---|---|---|---|
| | Difference between the temperature of original molten steel and melting point of steel (° C.) | Content in original molten steel (%) | Content of free oxygen in molten steel upon completion of decarbonization (ppm) | Input amount of Al (kg) | Grade of type C inclusions (kg) | $\mu_{10}+\mu_{15}$ (G/Oe) | $P_{10/50}$ (w/kg) | $P_{15/50}$ (w/kg) | Motor efficiency (%) |
| Example 1 | 61 | 0.021 | 550 | 125 | Grade 1.0 | 8,605 | 2.24 | 4.73 | 91.1 |
| Example 2 | 81 | 0.034 | 400 | 87.5 | Grade 1.0 | 8,629 | 2.17 | 4.62 | 91.5 |
| Example 3 | 124 | 0.043 | 300 | 62.5 | Grade 1.0 | 8,687 | 2.11 | 4.58 | 91.8 |
| Example 4 | 147 | 0.06 | 280 | 57.5 | Grade 1.5 | 8,578 | 2.32 | 4.89 | 90.6 |
| Comparative example 1 | 61 | 0.021 | 550 | 115 | Grade 2.0 | 8,416 | 2.49 | 5.3 | 89.4 |
| Comparative example 2 | 61 | 0.021 | 550 | 135 | Grade 2.0 | 8,449 | 2.45 | 5.1 | 89.9 |
| Comparative example 3 | No deoxidation in RH refining | | | | Grade 2.0 | 8,347 | 2.59 | 5.5 | 88.9 |

It can be seen from Table 1 that, compared with Comparative Example 3 which does not adopt deoxidation process in RH refining, non-oriented silicon steel in the examples which use deoxidation process in RH refining significantly decreases the amount of inclusions. The magnetic permeability at 1.0 T and 1.5 T of non-oriented silicon steel in examples increases at least 100 G/Oe, and both iron loss and motor efficiency thereof are significantly improved.

Furthermore, compared with Comparative Example 1 having an excessively low input amount of Al and comparative Example 2 having an excessively high input amount of Al, non-oriented silicon steel in examples has better magnetic permeability, iron loss and motor efficiency. Therefore, when the input amount of Al as the deoxidizer Y and the content of free oxygen upon the completion of decarbonization [O] satisfy the following formula: $Y=K\times m\times([O]-50)$ (wherein, K is $0.88\times10^{-3}$), a more optimal improving effect can be obtained with respect to the magnetic permeability, iron loss and motor efficiency of non-oriented silicon steel.

EXAMPLE 5

Firstly, a casting slab containing the following ingredients as calculated by weight percentage is obtained by steel making: C 0.001%, Si 2.15%, Al 0.35%, Mn 0.24%, P 0.018%, S 0.003% and N 0.0012%, Fe and other unavoidable impurities as the remains; RH refining is used in the steel making, wherein silicon iron or calcium as the deoxidizer is used for deoxidation treatment in RH refining. The input amount of deoxidizer Y and the content of free oxygen upon the completion of decarbonization [O] satisfy the following formula: $Y=K\times m\times([O]-50)$.

Next, the casting slab is subject to hot roll to form hot-rolled steel strip, wherein the final rolling temperature is 800° C. or more, and the thickness of hot-rolled steel strip after hot rolling is 2.3 mm.

Then, the hot-rolled steel strip is subject to the normalizing high-temperature treatment for short-time, i.e., the hot-rolled steel strip is heated to 980° C. and hold for 10~90 s, and is cooled to 650° C. at a cooling speed of about 5°/s, and then is naturally cooled.

Next, the hot-rolled steel strip after normalizing treatment is subject to cold roll to form the cold-rolled steel strip, which has a thickness of 0.5 mm after cold rolling.

Finally, at an atmosphere of nitrogen and hydrogen, it is subject to anneal at 800° C. for 20 s, and thus non-oriented silicon steel in Example 5 is obtained.

EXAMPLE 6

Non-oriented silicon steel is produced in the same method as that used in Example 5, except the holding temperature in the normalizing step is changed to 1,030° C.

EXAMPLE 7

Non-oriented silicon steel is produced in the same method as that used in Example 5, except the holding temperature in the normalizing step is changed to 1,050° C.

EXAMPLE 8

Non-oriented silicon steel is produced in the same method as that used in Example 5, except the holding temperature in the normalizing step is changed to 1,100° C.

COMPARATIVE EXAMPLE 4

Non-oriented silicon steel is produced in the same method as that used in Example 5, except the holding temperature in the normalizing step is changed to 920° C.

The grain size of the steel strip after normalizing treatment in the above examples and comparative examples are measured, and the magnetic permeability ($\mu_{10}+\mu_{15}$), iron loss $P_{10/50}$ and $P_{15/50}$ and motor efficiency (11 kw~6 grade motor) of the final silicon steel products (0.5 mm thickness) are measured. The results are shown in Table 2.

TABLE 2

| | Normalizing process parameter | | Grain size of | Magnetic property | | | Motor |
|---|---|---|---|---|---|---|---|
| | Holding temperature in Normalizing (° C.) | Cooling speed before 650° C. (° C./s) | steel strip after normalizing (μm) | $\mu_{10}+\mu_{15}$ (G/Oe) | $P_{10/50}$ (w/kg) | $P_{15/50}$ (w/kg) | efficiency (%) |
| Example 5 | 980 | 5 | 133 | 9,068 | 1.49 | 3.25 | 90.6 |
| Example 6 | 1,030 | 5 | 141 | 9,105 | 1.41 | 3.13 | 91.1 |
| Example 7 | 1,050 | 5 | 148 | 9,189 | 1.37 | 3.01 | 91.3 |
| Example 8 | 1,100 | 5 | 157 | 9,226 | 1.29 | 2.87 | 92.1 |
| Comparative example 4 | 920 | 5 | 114 | 8,965 | 1.58 | 3.41 | 87.4 |

It can be seen from Table 2 that, compared with Comparative Example 4 which adopts low-temperature normalizing, the examples which adopt the normalizing high-temperature treatment for short-time significantly increase the grain size of steel strip after normalizing. The magnetic permeability at 1.0 T and 1.5 T of non-oriented silicon steel in examples increases at least 100 G/Oe, and both iron loss and the motor efficiency thereof are significantly improved.

In addition, it can be seen from Tables 1 and 2 that, the iron loss $P_{10/50}$ and $P_{15/50}$ of non-oriented silicon steel in examples of the present invention are respectively 3.0 w/kg or less and 5.5 w/kg or less, and using non-oriented silicon steel in examples can obtain a motor efficiency of 90% or more.

Furthermore, the present inventor measured the grain diameter, surface layer property, sulphur content and yield strength $\sigma_s$ of non-oriented silicon steel in examples 1~8. The results show that, non-oriented silicon steel in examples has a grain diameter of between 60 μm and 105 μm, S content of 15 ppm or less, the total nitride concentration in the surface layer of 0~20 μm of 250 ppm or less, and the total nitride concentration of not more than $5.85C_N$. In addition, the yield strength $\sigma_s$ of non-oriented silicon steel in examples is no less than 220 MPa.

Furthermore, the present inventor investigates the relation between the magnetic permeability and iron loss of non-oriented silicon steel at 1.0 T and 1.5 T in examples 1~8, and the results indicate that, the magnetic permeability of non-oriented silicon steel in examples satisfies the following formula:

$$\mu_{10}+\mu_{15}\geq 8{,}000 \quad (1);$$

$$\mu_{15}\geq 865.7+379.4P_{15/50} \quad (2)$$

$$\mu_{10}+\mu_{15}\geq 10{,}081-352.1P_{15/50} \quad (3)$$

The experimental results of the present invention indicate that, by proper deoxidation control in RH refining and high-temperature treatment for short-time in the normalizing step, the present invention can reduce the amount of inclusions in the non-oriented silicon steel, improve grain shapes, and thus improve the magnetic permeability and iron loss of non-oriented silicon steel at 1.0~1.5 T and obtain a high motor efficiency.

BENEFICIAL EFFECTS OF THE PRESENT INVENTION

By proper deoxidation control in RH refining and high-temperature treatment for short-time in the normalizing step, the present invention can provide the non-oriented silicon steel with high magnetic permeability and low iron loss. The non-oriented silicon steel in the present invention can obtain a motor efficiency of 90% or more when used as iron core in electronic devices, and satisfy miniaturization and energy conservation requirements of electronic devices such as rotary machines and static machines, thus has a broad application prospect.

The invention claimed is:

1. A method for producing a non-oriented silicon steel, comprising the following steps in sequence: a) steel making, b) hot rolling, c) normalizing, d) cold rolling, and e) annealing, wherein, said steel making step a) is used for obtaining a casting slab having the following components by weight: C≤0.005%, 0.1%≤Si≤2.5%, Al≤1.5%, 0.10%≤Mn≤2.0%, P≤0.2%, S≤0.005%, N≤0.005%, Nb+V+Ti≤0.006%, and the balance being Fe and inevitable impurities;

said steel making step a) includes RH refining, wherein decarbonization treatment and deoxidation treatment are proceeded in RH refining; the input amount of the deoxidizer Y satisfies the following formula: Y =K×m×([O]−50), wherein [O] represents the content of free oxygen in unit of ppm upon the completion of decarbonization; K represents a coefficient indicating deoxidation capacity of the deoxidizer, and is in the range from $0.35\times10^{-3}$ to $1.75\times10^{-3}$; m represents the weight of molten steel contained in the steel ladle, in the unit of ton;

in said normalizing step c), the hot-rolled steel strip after hot rolling is heated to a temperature of phase transformation point temperature $Ac_1$ or above and 1,100° C. or below and is held for a time period t of 10~90 s, and the steel strip after holding is cooled at a cooling speed of 15° C/s or less to a temperature of 650° C. and then is cooled naturally, and in said annealing step e), the cold-rolled steel strip after cold rolling is heated to a temperature of 700~1,050° C. and is held for 1~120 sec, and then is cooled naturally.

2. The method for producing a non-oriented silicon steel according to claim 1, wherein said casting slab further contains Sn and/or Sb, wherein the content of Sn is 0.1 wt % or less, and the content of Sb is 0.1 wt % or less.

3. The method for producing a non-oriented silicon steel according to claim 1, wherein said deoxidizer in said RH refining is aluminum, silicon iron, or calcium.

4. The method for producing a non-oriented silicon steel according to claim 3, wherein K is $0.88\times10^{-3}$ when said deoxidizer in said RH refining is aluminum.

5. The method for producing a non-oriented silicon steel according to claim 3, wherein K is $1.23\times10^{-3}$ when said deoxidizer in said RH refining is silicon iron.

6. The method for producing a non-oriented silicon steel according to claim 3, wherein K is $0.70\times10^{-3}$ when said deoxidizer in said RH refining is calcium.

7. The method for producing a non-oriented silicon steel according to claim 1, wherein a final rolling temperature in said hot rolling step b) is 800~900° C.

8. The method for producing a non-oriented silicon steel according to claim 1, wherein in said cold rolling step d), the rolling reduction is 45% or more.

* * * * *